US011832744B1

(12) United States Patent
Capizzi

(10) Patent No.: US 11,832,744 B1
(45) Date of Patent: Dec. 5, 2023

(54) DRINKING CUP WITH ICE RETAINER

(71) Applicant: Gregory Capizzi, Point Pleasant, NJ (US)

(72) Inventor: Gregory Capizzi, Point Pleasant, NJ (US)

( * ) Notice: Subject to any disclaimer, the term of this patent is extended or adjusted under 35 U.S.C. 154(b) by 0 days.

(21) Appl. No.: 17/852,522

(22) Filed: Jun. 29, 2022

(51) Int. Cl.
*A47G 19/22* (2006.01)

(52) U.S. Cl.
CPC ..... *A47G 19/2216* (2013.01)

(58) Field of Classification Search
CPC ..... A47G 19/2216; A47G 19/2211; A47G 19/2266; A47G 19/12; A47G 19/2288; F25D 2303/081; F25D 2303/0842; B65D 3/24
USPC ..... 220/254.3, 703, 711, 713, 719, 720
See application file for complete search history.

(56) References Cited

U.S. PATENT DOCUMENTS 2,357,063 A 8/1944 Swing
2,459,558 A * 1/1949 Villegas De Oribe ..... A47G 19/2216 428/198
4,020,532 A 5/1977 Lichter
D315,478 S 3/1991 Liggens
D315,479 S 3/1991 Liggens
5,702,024 A 12/1997 Riso
5,727,712 A 3/1998 Costello
5,803,316 A * 9/1998 Couture ..... A47G 19/12 222/189.06
5,853,106 A 12/1998 Galluzzo
5,971,202 A 10/1999 Filbrun
8,113,378 B2 2/2012 Linnenbaum
8,474,641 B2 * 7/2013 Hays ..... B65D 3/24 220/703
9,320,374 B2 4/2016 Phipps
11,185,178 B1 * 11/2021 Nobari ..... A47G 19/2211
2008/0202150 A1 8/2008 Siordia
2011/0240664 A1 10/2011 Liggens

FOREIGN PATENT DOCUMENTS

FR 3094881 A1 4/2019

* cited by examiner

*Primary Examiner* — James N Smalley
*Assistant Examiner* — Madison L Poos
(74) *Attorney, Agent, or Firm* — Greenberg Traurig, LLP

(57) ABSTRACT

A drinking cup assembly includes a drinking cup configured to retain a liquid within an interior of the drinking cup, and a retainer configured to retain ice within the interior of the drinking cup while permitting the liquid to flow from the interior of the drinking cup. The drinking cup comprises a grip portion, wherein the grip portion comprises a retainer attachment section. The retainer comprises a cup attachment section, wherein the retainer attachment section disposed within the cup attachment section.

17 Claims, 14 Drawing Sheets

DRINKING CUP WITH ICE RETAINER

FIELD OF THE APPLICATION

The application relates to a drinking cup, and, more specifically, to a drinking cup including a retainer configured to retain ice or an ice-substitute, for example, within the drinking cup, while configured to permit a liquid within the drinking cup to flow out of the drinking cup.

BACKGROUND

Often, a person intending to drink from a drinking cup will add ice or an ice-substitute (such as a closed, sealed container filled with frozen water or another substance) as well as a liquid to the drinking cup, so that the ice or ice-substitute cools the liquid.

When the person tips the drinking cup which includes the ice or an ice-substitute to drink the liquid in the drinking cup, often the ice or ice-substitute is carried with the liquid to the opening of the cup. As a result, the ice or ice-substitute may impact the mouth, lips, chin, or other portion of the person's face while the person is drinking the liquid from the drinking cup.

SUMMARY

In an embodiment, a drinking cup assembly comprises a drinking cup configured to retain a liquid within an interior of the drinking cup; and a retainer configured to retain ice within the interior of the drinking cup while permitting the liquid to flow from the interior of the drinking cup, wherein the drinking cup comprises a grip portion, wherein the grip portion comprises a retainer attachment section, wherein the retainer comprises a cup attachment section, wherein the retainer attachment section disposed within the cup attachment section.

In an embodiment, a connection between the retainer attachment section and the cup attachment section comprises an interference fit.

In an embodiment, the connection further comprises a weld.

In an embodiment, the connection further comprises an adhesive connection.

In an embodiment, a connection between the retainer attachment section and the cup attachment section comprises an adhesive connection.

In an embodiment, a connection between the retainer attachment section and the cup attachment section comprises a weld.

In an embodiment, the retainer attachment section comprises a substantially flat surface with at least one of a depression and a protrusion.

In an embodiment, the cup attachment section comprises at least one of a depression and a protrusion, configured to cooperatively attach to the at least one of the depression and the protrusion of the retainer attachment section.

In an embodiment, the retainer includes a plurality of openings configured to permit the liquid to flow through the openings and configured to retain the ice in the drinking cup.

In an embodiment, the retainer includes a plurality of openings configured to permit the liquid to flow through the openings and configured to retain the ice in the drinking cup.

In an embodiment, a drinking cup assembly comprises a drinking cup configured to retain a liquid within an interior; and a foldable retainer configured to retain ice within the interior of the drinking cup while permitting the liquid to flow from the interior of the drinking cup, wherein the retainer comprises a cup attachment section connected to an interior surface of the drinking cup, wherein the retainer is foldable from a first position against the interior surface of the drinking cup to a second position configured to retain the ice within the interior of the drinking cup.

In an embodiment, the retainer comprises at least one opening configured to permit the liquid to flow through the opening, and configured to prevent the ice from flowing through the opening.

In an embodiment, the retainer comprises multiple openings.

In an embodiment, the cup attachment section is welded to the interior surface of the drinking cup.

In an embodiment, the cup attachment section is adhered to the interior surface of the drinking cup by an adhesive.

In an embodiment, the retainer is disposed entirely within the drinking cup when disposed in the first position.

In an embodiment, the retainer extends from the interior surface of the drinking cup and is disposed entirely within the drinking cup when disposed in the second position.

In an embodiment, the retainer comprises two retainers.

In an embodiment, the cup attachment section connects both retainers to the inner surface of the drinking cup.

In an embodiment, the cup attachment section is welded or adhered to the inner surface of the drinking cup.

DETAILED DESCRIPTION

Figure 1:
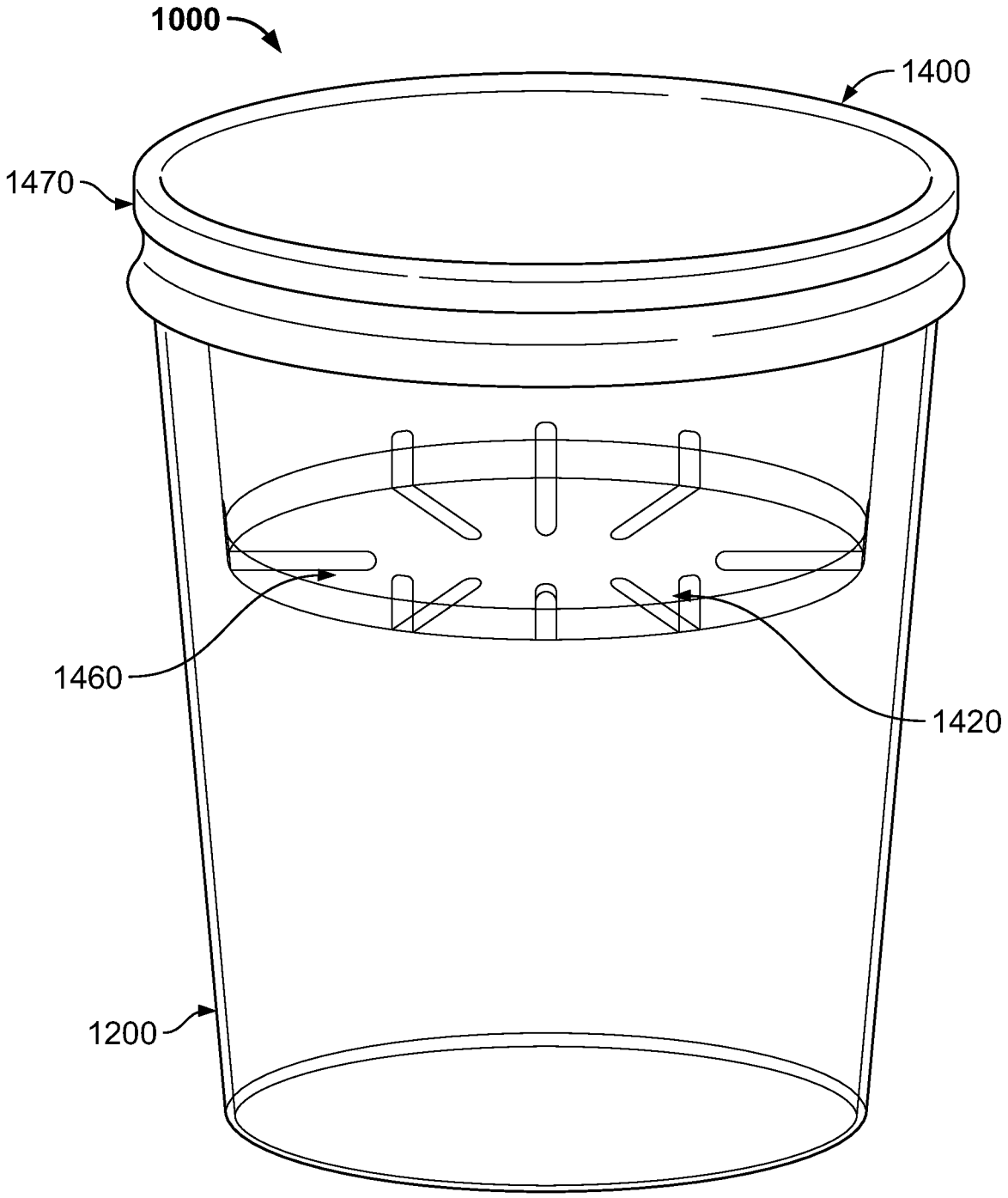
FIG. 1 is an isometric view of a first embodiment of a drinking cup assembly.
Figure 2:
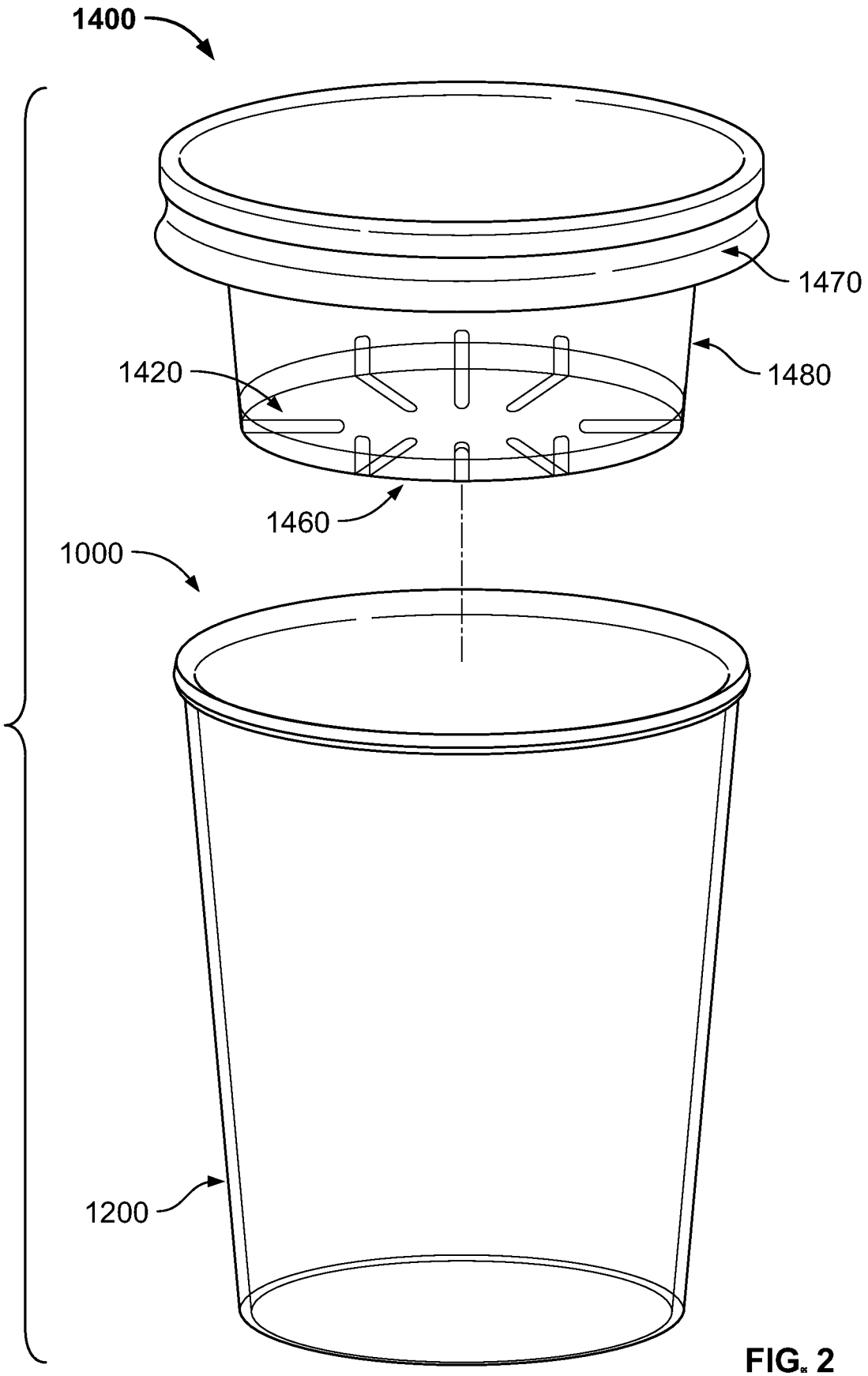
FIG. 2 is an exploded isometric view of the first embodiment of FIG. 1.
Figure 3:
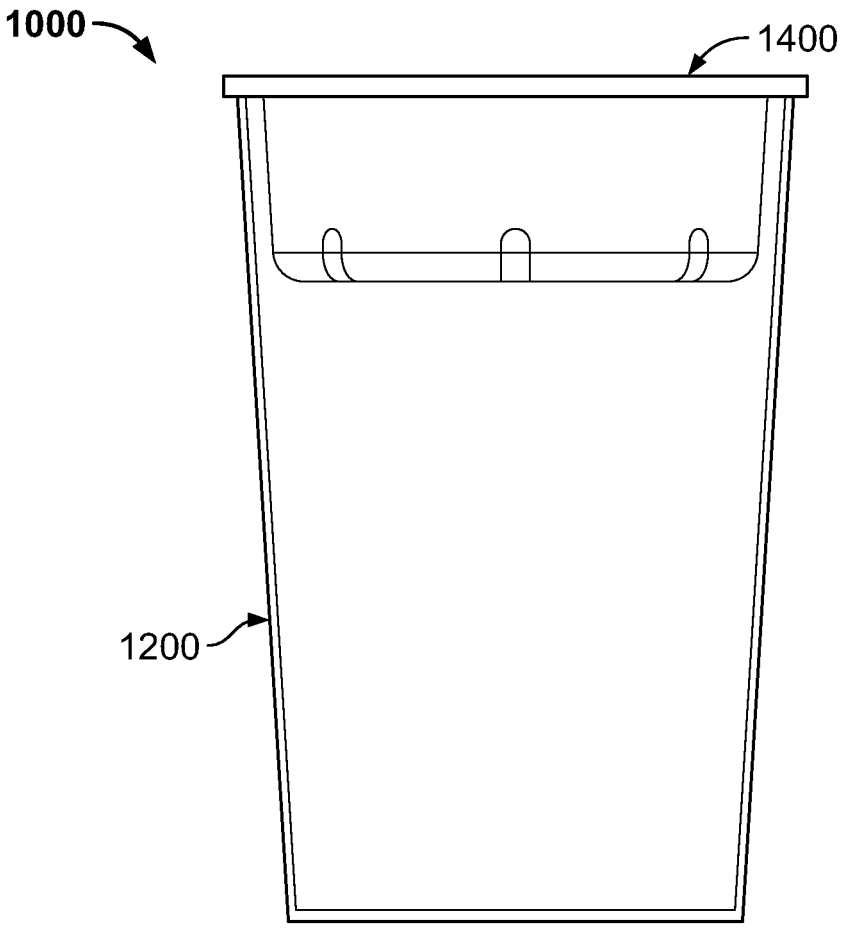
FIG. 3 is a side view of the first embodiment of FIG. 1.
Figure 4:
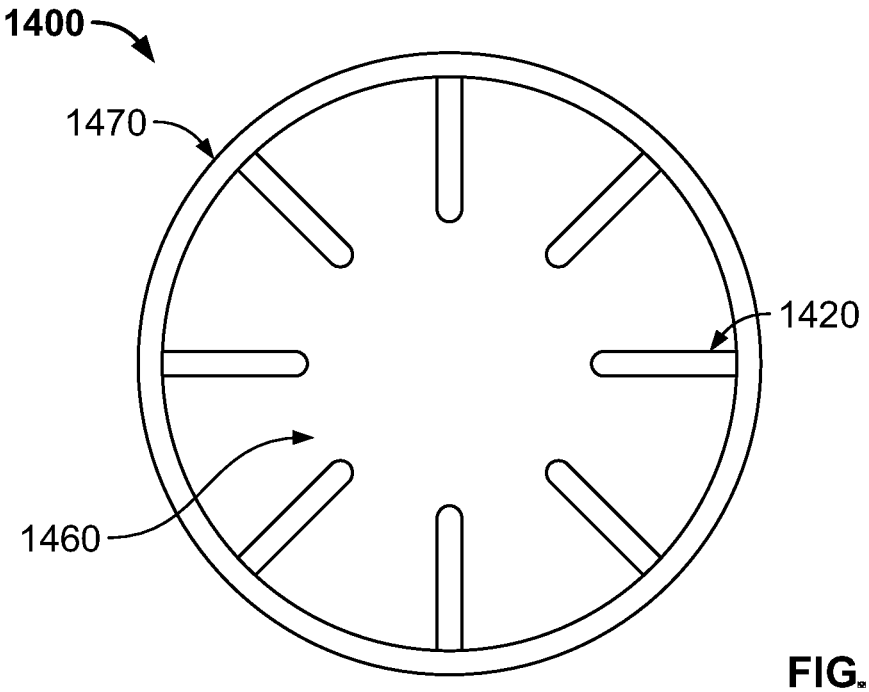
FIG. 4 is a top view of the retainer of the first embodiment of FIG. 1.
Figure 5:
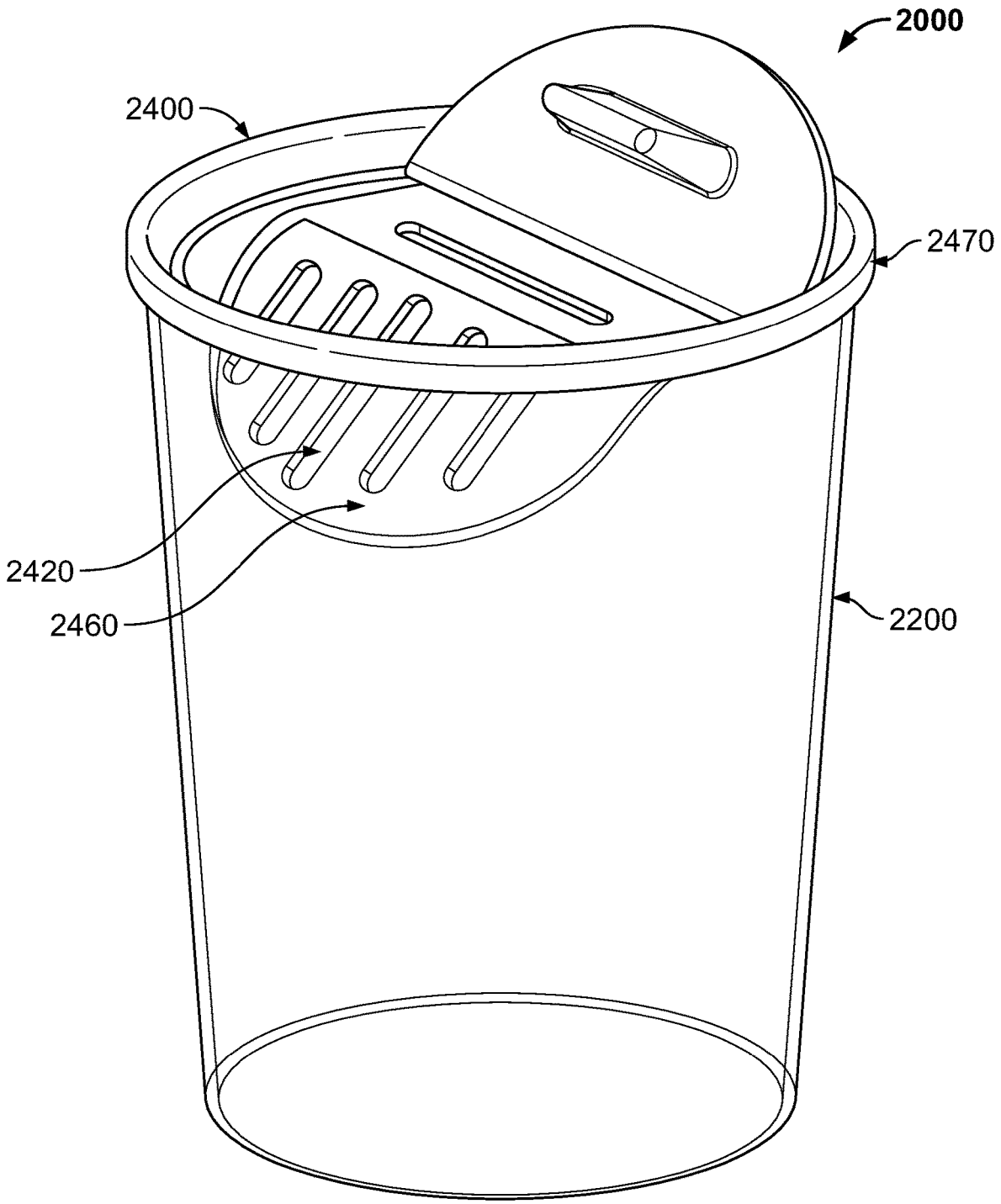
FIG. 5 is an isometric view of a second embodiment of the drinking cup assembly.
Figure 6:
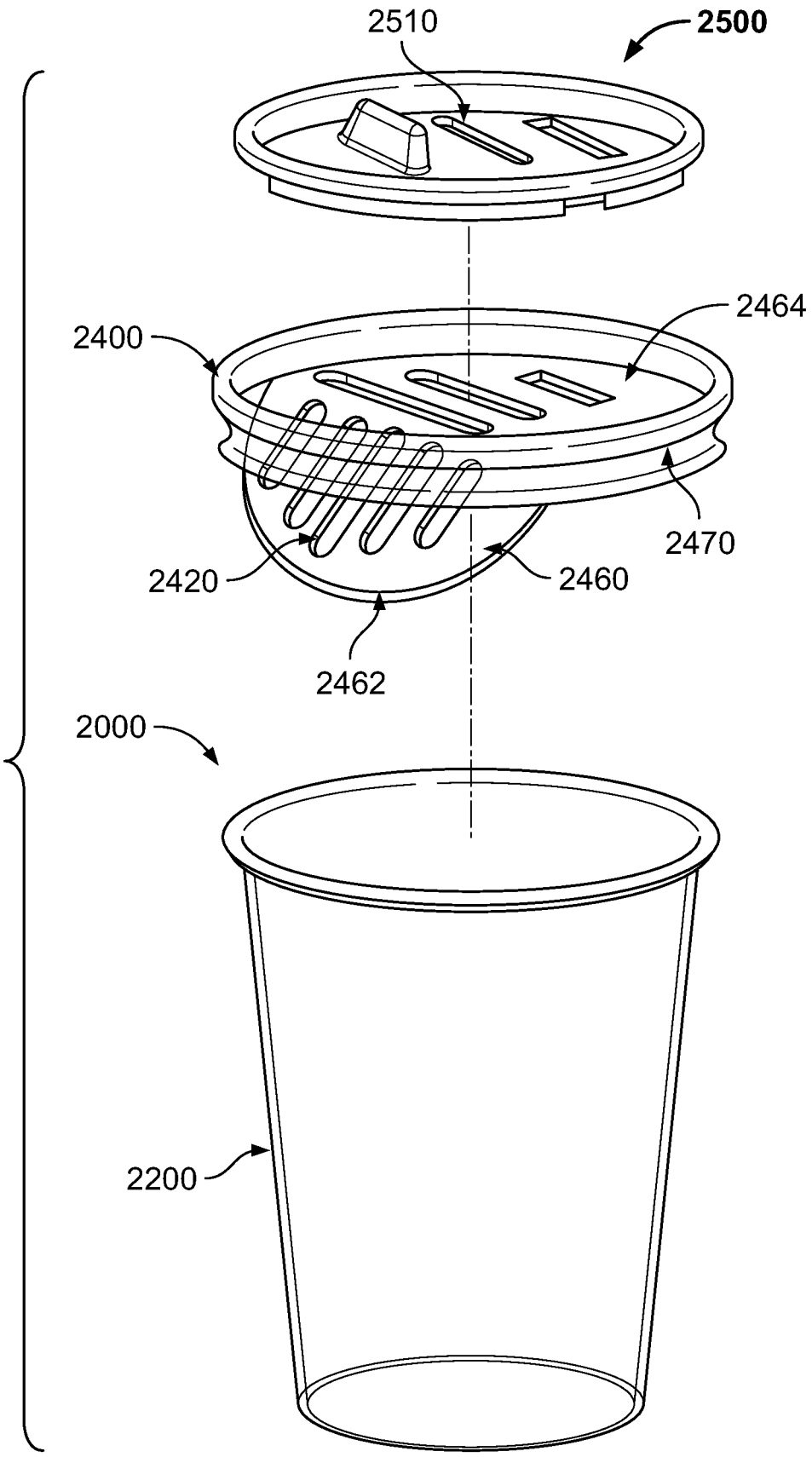
FIG. 6 is an exploded isometric view of the second embodiment of FIG. 5.
Figure 7:
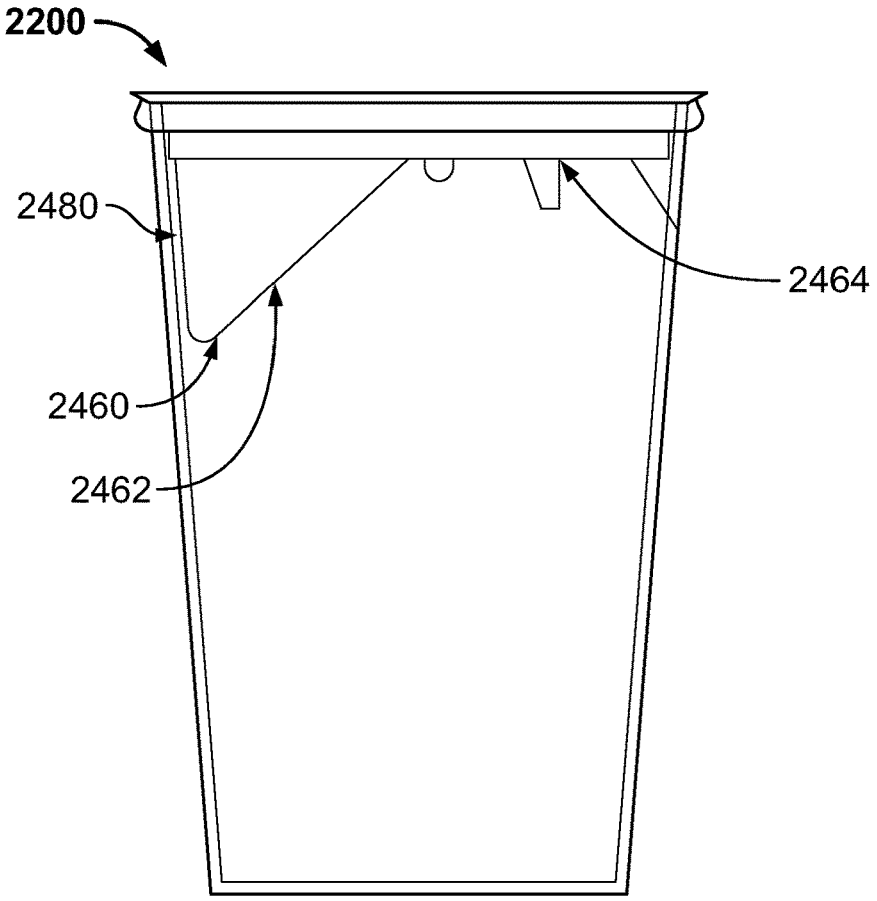
FIG. 7 is a side view of the second embodiment of FIG. 5.
Figure 8:
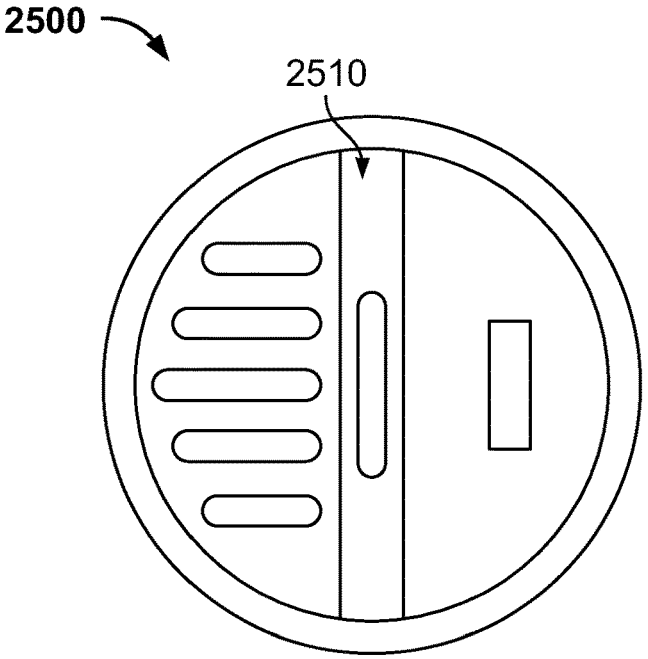
FIG. 8 is a top view of the retainer and lid of the second embodiment of FIG. 5.

FIGS. 1-4 illustrate a first embodiment of the drinking cup assembly. As shown in the figures, drinking cup assembly 1000 includes drinking cup 1200 and retainer 1400. Drinking cup 1200 may be configured to hold a liquid, such as a beverage, which a person intends to drink. The figures show a liquid and ice in drinking cup 1200.

Drinking cup 1200 may be formed from any material capable of holding the liquid. For example, the material of drinking cup 1200 may be one or more of: plastic, glass, metal such as steel or aluminum, bamboo, wheat, corn, paper, waxed paper, sugarcane, and/or any other material. Drinking cup 1200 may or may not be one or more of: disposable or non-disposable, recyclable or non-recyclable, compostable or non-compostable, or biodegradable or non-biodegradable. Drinking cup 1200 may be provided with, or may be provided separate from, retainer 1400. Drinking cup 1200 may be any of clear, translucent, or opaque. Drinking cup 1200 may be sized and shaped to hold any desired quantity of liquid.

Retainer 1400 may be formed from any material capable of retaining, to at least some degree, any solid, semi-solid, non-liquid, or semi-liquid within drinking cup 1200, while permitting another solid, semi-solid, non-liquid, or semi-liquid of or below a predetermined size, or permitting the liquid, within drinking cup 1200, to flow out of drinking cup 1200, such as when a person tips drinking cup 1200 intending to drink the liquid disposed therein. By way of example, retainer 1400 may retain within drinking cup 1200 one or more of: ice, an ice-substitute, a fruit, a vegetable, or any other object, while permitting the user to drink the liquid within drinking cup 1200. Retainer 1400 may be any of clear, translucent, or opaque.

Retainer 1400 may include one or more openings 1420 sized, shaped, oriented, and/or disposed to permit the liquid in drinking cup 1200 to flow through retainer 1400, while preventing, to at least some degree, an object (such as the ice or the ice-substitute) within the liquid from flowing through retainer 1400 and/or out of drinking cup 1200.

Retainer 1400 may include any number of openings 1420, such as, for example, one, two, three, four, five, six, seven, eight, or more opening 1420. As shown in the figures, retainer 1400 includes eight openings 1420. Openings 1420 may be formed anywhere within or on retainer 1400. For example, openings 1420 may be formed around an outer circumference of bottom surface 1460 of retainer 1400. Bottom surface 1460 may be any shape, such as substantially flat or dome-shaped, for example. Some or all openings 1420 may be the same size as, or different sizes than, one or more openings 1420. Openings 1420 may be any shape, including but not limited to slots, circles, arcs, or polygons, or any other shape. Openings 1420 may be distributed equally on bottom surface 1460 of retainer 1400, or may be distributed unequally on bottom surface 1460 of retainer 1400. As shown in the figures, openings 1420 are slots of substantially the same size, distributed equally on bottom surface 1460.

Retainer 1400 may include attachment section 1470, configured to attach retainer 1400 to an upper edge of drinking cup 1200. Attachment section 1470 may be sized, shaped, located, or otherwise disposed to permanently or temporarily attach retainer 1400 to drinking cup 1200. For example, attachment section 1470 may be sized, shaped, and/or made of an appropriate material, such that attachment section 1470 achieves a snap-fit (that is, an interference fit resulting from deformation of attachment section 1470) with the upper edge of drinking cup 1200.

For example, attachment section 1470 may permanently attach retainer 1400, which is intended to be disposable, to drinking cup 1200 that also is intended to be disposable. Attachment section 1470 may attach to any portion of a circumference of the upper edge of drinking cup 1200. For example, attachment section 1470 may attach to about 10%, 25%, 50%, 75%, 80%, 90%, 95%, 99% or 100% of the circumference of the upper edge of drinking cup 1200. Attachment section 1470 may be connected to side wall 1480, which is connected to bottom surface 1460, of retainer 1400. Side wall 1480 may extend any percentage around the circumference of an inner wall or surface of drinking cup 1200. For example, side wall 1480 may extend about 10%, 25%, 50%, 75%, 80%, 90%, 95%, 99%, or 100% of the circumference of the inner wall or surface of drinking cup 1200. Openings 1420 may or may not be formed in at least some portion of side wall 1480.

A method of using drinking cup assembly 1000 may include filling drinking cup 1200 with ice or an ice-substitute, as well as a liquid. The method may include attaching attachment section 1470 of retainer 1400 to an upper edge of drinking cup 1200, before or after adding the ice, ice substitute, and/or liquid to drinking cup 1200, thereby to secure retainer 1400 to drinking cup 1200. Openings 1420 may be sized, shaped, oriented, and distributed to permit the liquid with drinking cup 1200 to pass through the openings 1420, while openings 1420 may prevent the ice or ice-substitute from passing through openings 1420, such as when the user tips drinking cup 1200 to drink the liquid within drinking cup 1200.

FIGS. 5-8 illustrate a second embodiment of the drinking cup assembly. As shown, drinking cup assembly 2000 includes drinking cup 2200 and retainer 2400. Drinking cup 2200, like all of the embodiments of drinking cups disclosed herein, may be similar to any other drinking cup described herein, such as drinking cup 1200. Retainer 2400, like all of the embodiments of retainers disclosed herein, may be similar to any other retainers described herein, such as retainer 1400, except to the extent that retainer 2400 is described below as differing from other retainers.

Retainer 2400 may include any number of openings 2420, such as, for example, one, two, three, four, five, or more opening 2420. As shown in the figures, retainer 2400 includes five openings 2420. Openings 2420 may be formed anywhere within or on retainer 2400, such as on bottom surface 2460. For example, openings 2420 may be formed around an outer circumference of bottom surface 2460 of retainer 2400. Openings 2420 may be the same size as, or different sizes than, one or more other openings 2420. Openings 2420 may be any shape, including but not limited to slots, circles, arcs, and polygons. Openings 2420 may be distributed equally on retainer 2400, or may be distributed unequally on retainer 2400. As shown in the figures, openings 2420 may include five slots, substantially parallel to one another.

Retainer 2400 may include attachment section 2470, configured to attach retainer 2400 to an upper edge of drinking cup 2200. Attachment section 2470 may be sized, shaped, or otherwise configured to permanently or temporarily attach retainer 2400 to drinking cup 2200. For example, attachment section 2470 may be sized, shaped, and/or made of an appropriate material, such that attachment section 2470 achieves a snap-fit with the upper edge of drinking cup 2200. For example, attachment section 2470 may permanently attach retainer 2400, which is intended to be disposable, to cup 2200 that also is intended to be disposable. Attachment section 2470 may attach to any portion of a circumference of the upper edge of drinking cup 2200. For example, attachment section 2470 may attach to about 10%, 25%, 50%, 75%, 80%, 90%, 95%, 99% or 100% of the circumference of the upper edge of drinking cup 2020. Attachment section 2470 may be connected to side wall 2480, which is connected to bottom surface 2460, of retainer 2400. Side wall 2480 may extend any percentage around the circumference of an inner wall or surface of drinking cup 2200. For example, side wall 2480 may extend about 10%, 25%, 50%, 75%, 80%, 90%, 95%, 99% or 100% of the circumference of the inner wall or surface of drinking cup 2200.

Attachment section 2470 may be connected to side wall 2480, which is connected to bottom surface 2460. Side wall 2480 may extend any percentage around the circumference of the inner wall or surface of drinking cup 2020. For example, side wall 2480 may extend about 10%, 25%, 50%, 75%, 80%, 90%, 95%, 99%, or 100% of the circumference of the inner wall or surface of drinking cup 2420. As shown in the figures, side wall 2480 extends 100% of the circumference of the inner wall or surface of drinking cup 2420.

Bottom surface 2460 may include first portion 2462 and second portion 2464, where first portion 2462 is relatively flat and disposed relatively horizontally, and second portion 2464 is relatively flat and disposed at an angle relative to first portion 2462. Either first portion 2462 and/or second portion 2464 may include openings 2420. For example, the drawings show second portion 2464 including openings 2420.

The second embodiment may optionally also include sealing lid 2500. Sealing lid 2500 may attach to either or both of the upper edge of cup 2200 and/or any portion or portions of retainer 2400. Sealing lid 2500 may include a hinge 2510, which permits at least a portion of sealing lid 2500 to be moved relative to another portion of sealing lid 2500, so that the user may open sealing lid 2500 without removing lid sealing 2500, to drink the liquid from drinking cup 2200.

A method of using drinking cup assembly 2000 may be similar to a method of using drinking cup assembly 1000. The method of using assembly 2000 may or may not include attaching or removing sealing lid 2500, and/or opening and closing sealing lid 2500.

Figure 9:
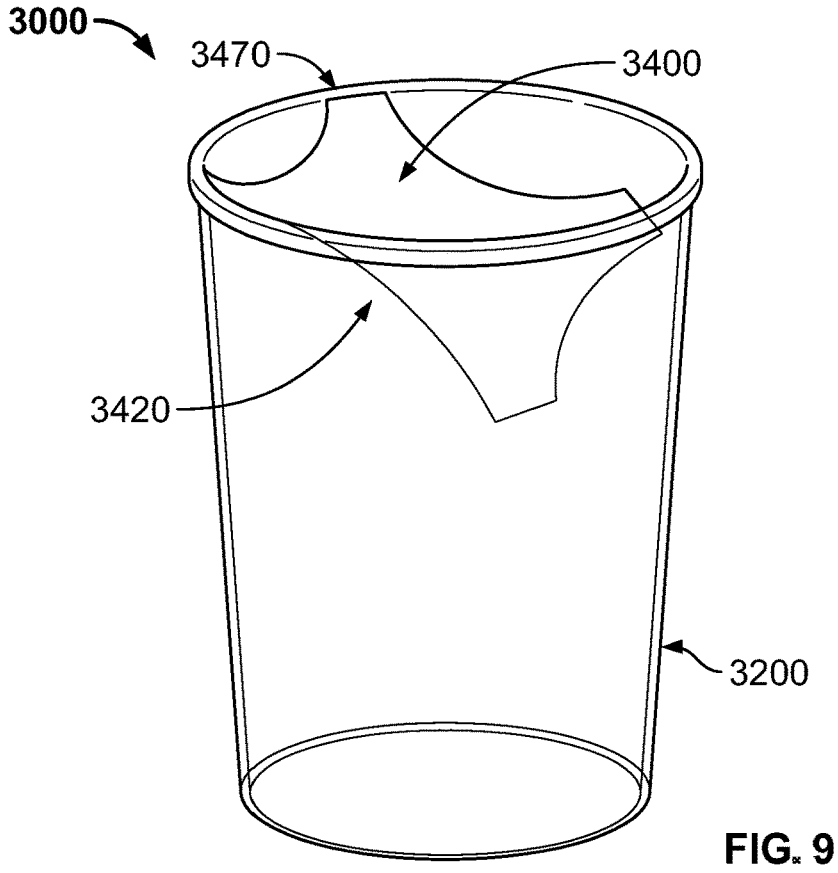
FIG. 9 is an isometric view of a third embodiment of the drinking cup assembly.
Figure 10:
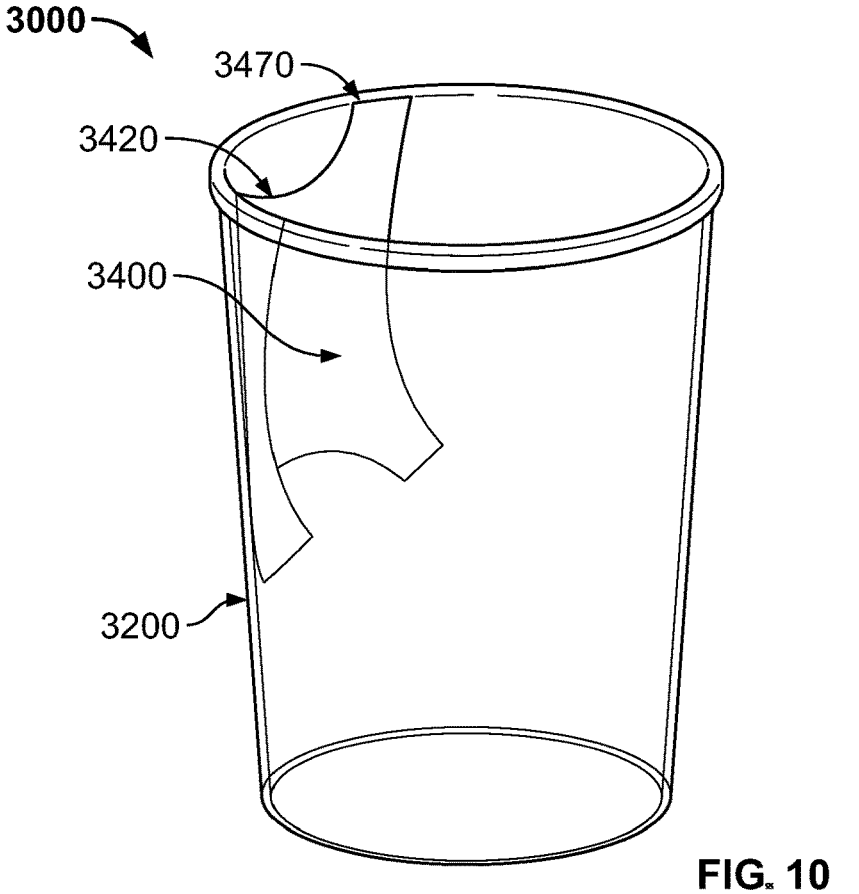
FIG. 10 is an isometric view of the third embodiment of FIG. 9.
Figure 11:
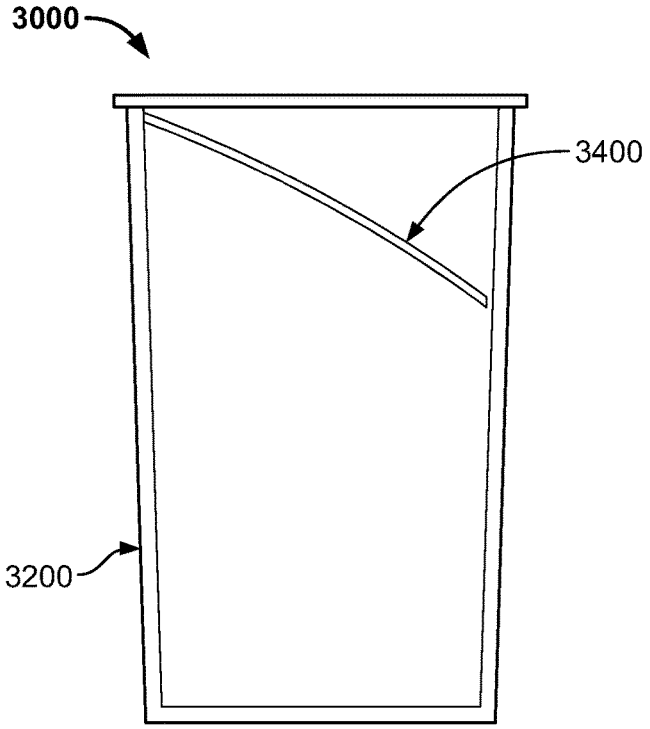
FIG. 11 is a side view of the third embodiment of FIG. 9.

FIGS. 9-11 illustrate a third embodiment of the drinking cup assembly. As shown, drinking assembly 3000 includes drinking cup 3200 and retainer 3400. Drinking cup 3200 may be similar to the other drinking cups described herein. Retainer 3400 may be similar to the other retainers, except to the extent that retainer 3400 is described below as differing from the other retainers.

Retainer 3400 may include any number of openings 3420, such as, for example, one, two, three, or four opening 3420. As shown in the figures, retainer 3400 includes four openings 3420. Openings 3420 may be formed anywhere within or on retainer 3400. For example, openings 3420 may be formed around an outer perimeter or circumference of retainer 3400. Openings 3420 may be the same size as, or different sizes than, one or more other openings 3420. Openings 3420 may be any shape, including but not limited to slots, circles, curves, and polygons. Openings 3420 may be distributed equally on the perimeter or circumference of retainer 3400, or may be distributed unequally on retainer 3400. As shown in the figures, openings 3420 may include four substantially-arcuate sections, formed on the outer circumference of an otherwise at least substantially circular retainer 3400.

Retainer 3400 may include attachment section 3470, configured to attach retainer 3400 to the upper edge of drinking cup 3200. Attachment section 3470 may be configured to permanently or temporarily attach retainer 3400 to drinking cup 3200. For example, attachment section 3470 may permanently attach retainer 3400, intended to be disposable, to drinking cup 3200, intended to be disposable. Attachment section 3470 may attach to any portion of a circumference of the upper edge of drinking cup 3200. For example, attachment section 3470 may attach to about 10%, 25%, 50%, 75%, 80%, 90%, 95%, 99%, or 100% of the circumference of the upper edge of drinking cup 3200. Attachment section 3700 may be connected to the upper edge of cup 3200, such as by welding, gluing, adhering, or sonically-welding attachment section 3470 to drinking cup 3200. Attachment section 3470 and/or retainer 3400 may be sized, shaped, disposed, and/or configured such that when retainer 3400 is in a folded-down configuration as shown in FIG. 10, a plurality of drinking cups 3200 may be nested (that is, stacked at least partially) inside one another, and after filling drinking cup 3200 with ice or an ice-substitute, for example, retainer 3400 may be positioned as shown in FIG. 9. Attachment section 3470 and retainer 3400 may, but need not, be formed at the same time drinking cup 3200 is formed, such as when drinking cup 3200 is formed by thermoform molding.

A method of using drinking cup assembly 3000 may be similar to other method of using drinking cups described herein. The method of using drinking cup assembly 3000 may include removing drinking cup 3200 from a stack of drinking cups, where retainer 3400 is disposed within and folded against a side wall of drinking cup 3200, folding retainer 3400 to a configuration in which retainer 3400 is disposed substantially outside of drinking cup 3020 (that is, folded up), filling drinking cup 3200 with ice or an ice-substitute, as well as a liquid (either before or after folding up retainer 3400), and folding retainer down to a configuration in which retainer 2030 may retain the ice within drinking cup 3020 (as shown in FIG. 11).

Figure 12:
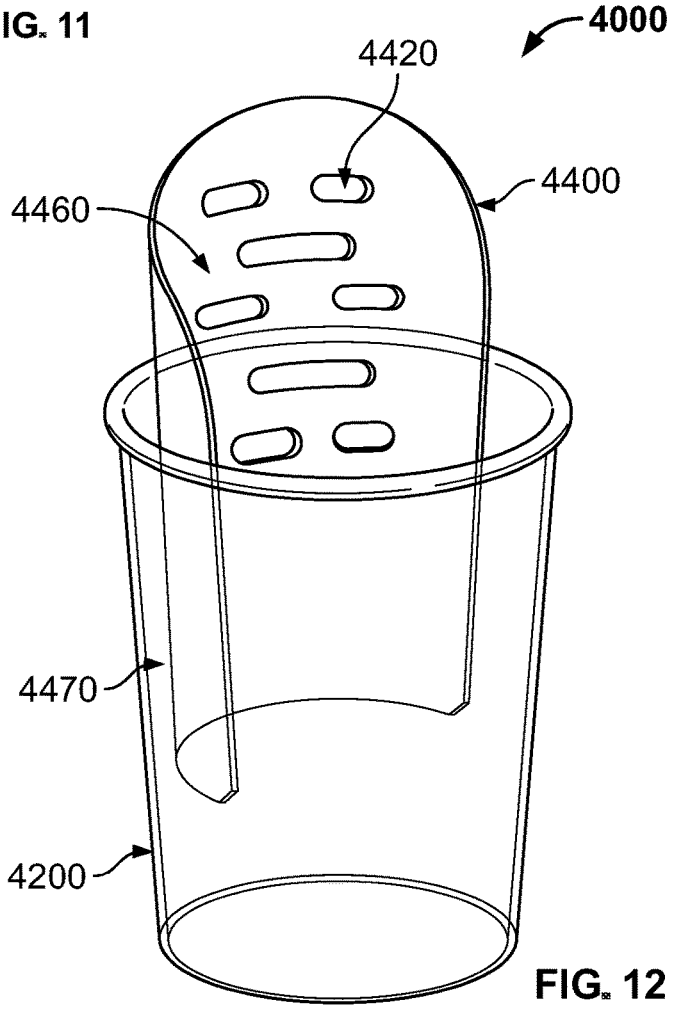
FIG. 12 is an isometric view of a fourth embodiment of the drinking cup assembly.
Figure 13:
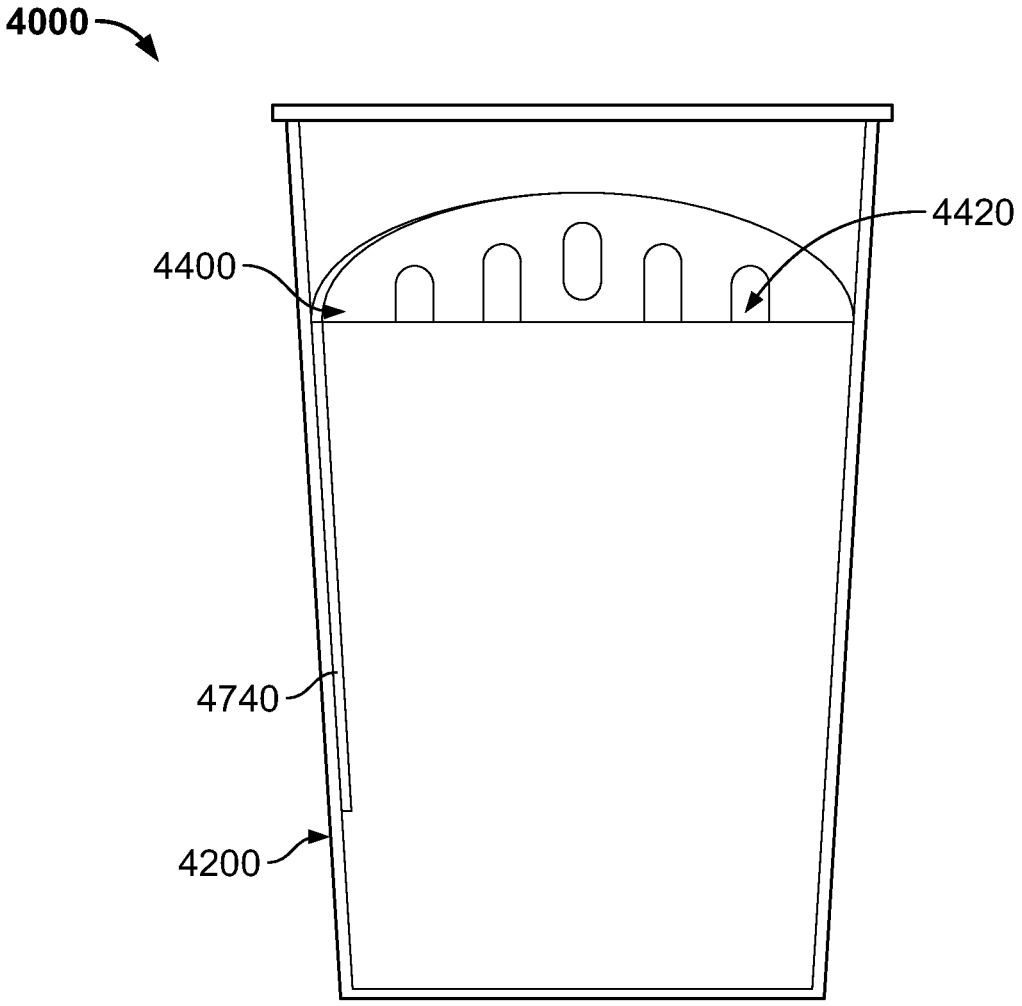
FIG. 13 is a side view of the fourth embodiment of FIG. 12.
Figure 14:
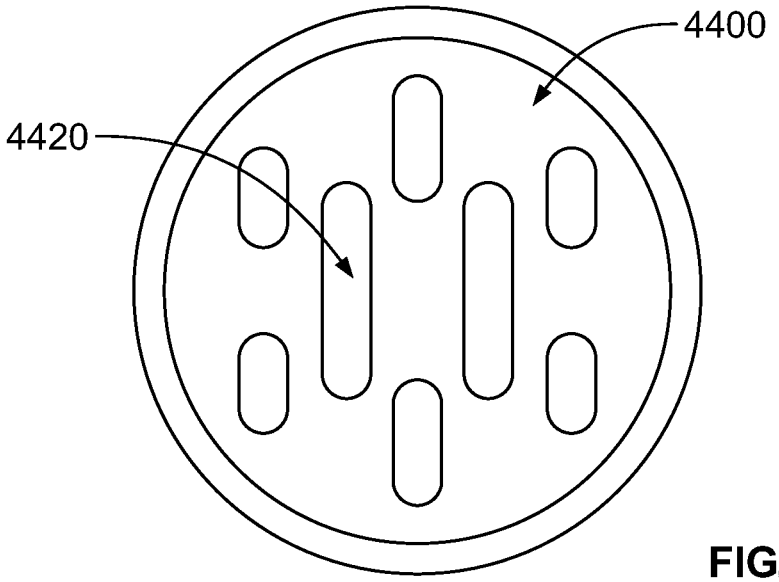
FIG. 14 is a top view of the fourth embodiment of FIG. 12.

FIGS. 12-14 illustrate a fourth embodiment of the drinking cup assembly. As shown, drinking cup assembly 4000 includes drinking cup 4200 and retainer 4400. Drinking cup 4200 may be similar to the other drinking cups described herein. Retainer 4400 may be similar to the other retainers, except to the extent that retainer 4400 is described below as differing from the other retainers.

Retainer 4400 may include any number of openings, such as, for example, one, two, three, four, five, six, seven, eight, or more opening 4420. As shown in the figures, retainer 4400 includes eight openings 4420. Openings 4420 may be formed anywhere within or on retainer 4400. For example, openings 4420 may be formed on bottom surface 4460 of retainer 4400. Openings 4420 may be the same size as, or different sizes than, one or more other openings 4420. Openings 4420 may be any shape, including but not limited to slots, circles, arcs, and polygons. Openings 4420 may be distributed equally on retainer 4400, or may be distributed unequally on retainer 4400. Openings 4420 may be the same size as, or different sizes than, one or more other openings 4420. Openings 4420 may be any shape, including but not limited to slots, circles, arcs, and polygons. Openings 4420 may be distributed equally on retainer 4400 or may be distributed unequally on retainer 4400. As shown in the figures, openings 4420 may be of various sizes.

Retainer 4400 may include attachment section 4470, configured to attach retainer 4400 to the inner surface of drinking cup 4200. Attachment section 4470 may be configured to permanently or temporarily attach retainer 4400 to drinking cup 4200. For example, attachment section 4470 may permanently attach retainer 4400, configured to be disposable, to drinking cup 4200, also configured to be disposable. Attachment section 4470 may be connected to the inner surface of cup 4200, such as by welding, adhering, gluing, or sonically-welding attachment section 4470 to cup 4200. Attachment section 4470 may be sized and shaped such that when attachment section 4470 and/or retainer 4400 are in a folded-up configuration, as shown in FIG. 12, a plurality of drinking cups 4200 may be nested inside one another. When in the folder-up configuration, retainer 4400 may be disposed above and outside of drinking cup 4200. When retainer 4400 is folded down to retain the ice in drinking cup 4200, that is, to be substantially horizontal (as shown in FIGS. 13 and 14), at least a portion of retainer 4400 may be any shape, such as substantially flat or a hyperbolic paraboloid shape (that is, saddle-shaped).

A method of using drinking cup assembly 4000 may be similar to other methods of using drinking cups described herein. A method of using drinking cup assembly 4000 may include removing drinking cup 4200 from a stack of drinking cups, where retainer 4400 is disposed substantially outside of drinking cup 4200 (as shown in FIG. 12), filling drinking cup 4200 with ice or an ice-substitute, as well as a liquid, and folding retainer 4400 to a configuration in which retainer 4400 may retain the ice within drinking cup 4020 (that is, folded down to be substantially saddle-shaped and disposed entirely within drinking cup 4200, as shown in FIG. 13).

FIGS. 15-18 illustrate a fifth embodiment of the drinking cup assembly. As shown, drinking cup assembly 5000 includes drinking cup 5200 and retainer 5400. Drinking cup 5200 may be similar to the other drinking cups described herein. Retainer 5400 may be similar to the other retainers, except to the extent that retainer 5400 is described below as differing from the other retainers.

Retainer 5400 may include two retainers 5400, about equally distributed about the opening of drinking cup 5200, and each retainer 5400 including any number of openings 5420, such as, for example, one, two, three, or more opening 5420. As shown in the figures, each retainer 5400 includes three openings 5420. Openings 5420 may be formed anywhere within or on retainer 5400. Openings 5420 may be the same size as, or different sizes than, one or more other openings 5420. Openings 5420 may be any shape, including but not limited to slots, circles, arcs, and polygons. Openings 5420 may be distributed equally on retainer 5400, or may be distributed unequally on retainer 5400. As shown in the figures, openings 420 may include three substantially parallel slots on each retainer 5400.

Figure 15:
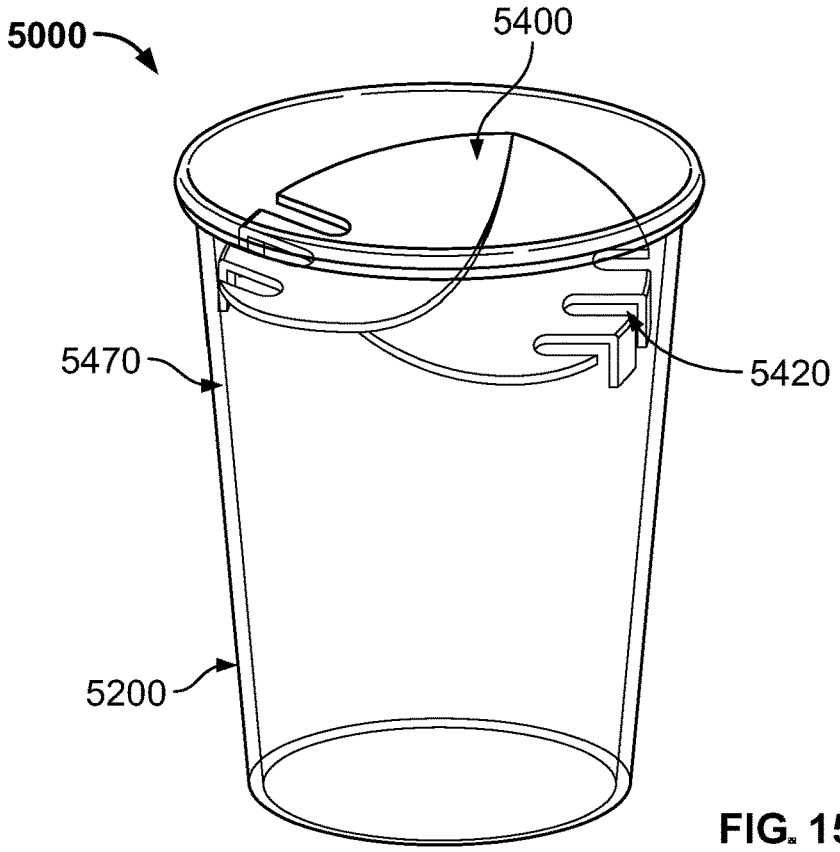
FIG. 15 is an isometric view of a fifth embodiment of the drinking cup assembly.
Figure 16:
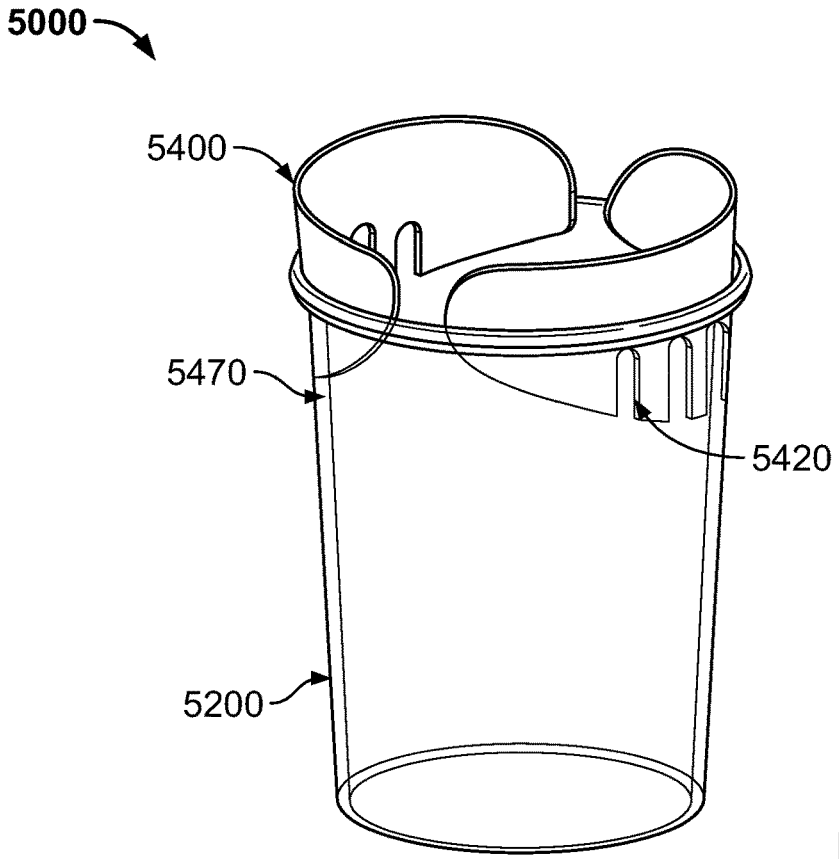
FIG. 16 is an isometric view of the fifth embodiment of FIG. 15.
Figure 17:
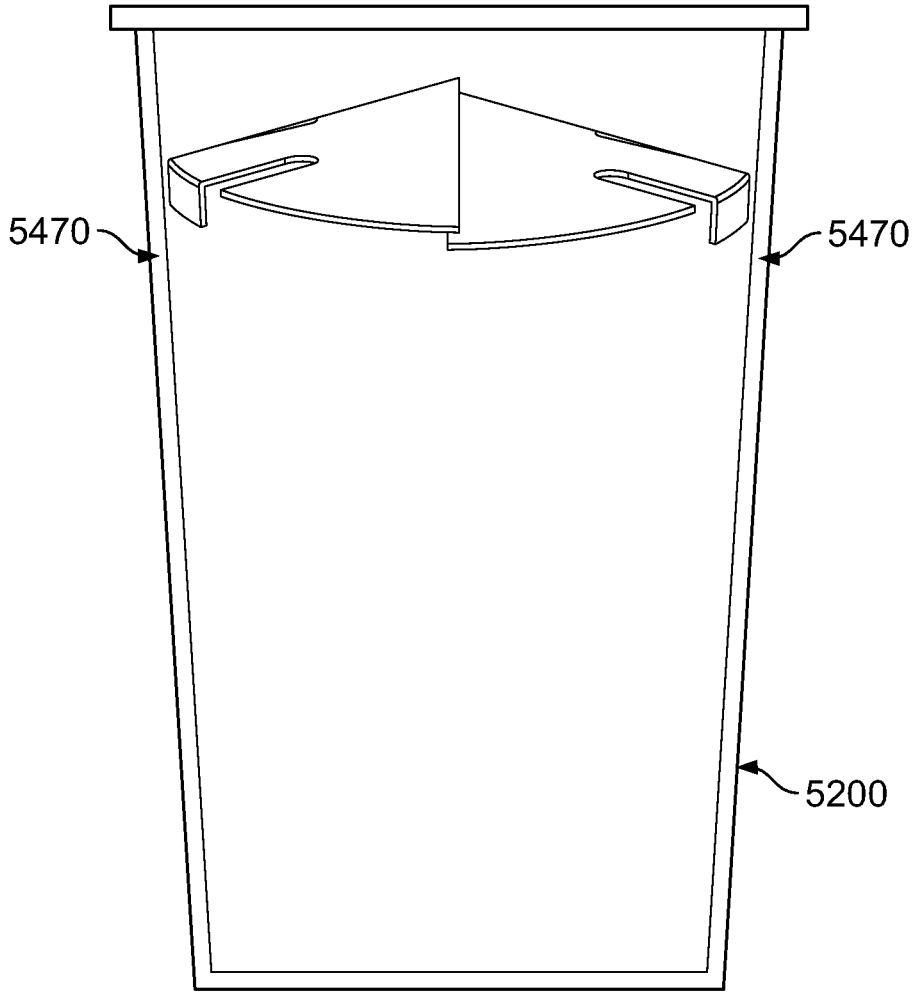
FIG. 17 is a side view of the fifth embodiment of FIG. 15.
Figure 18:
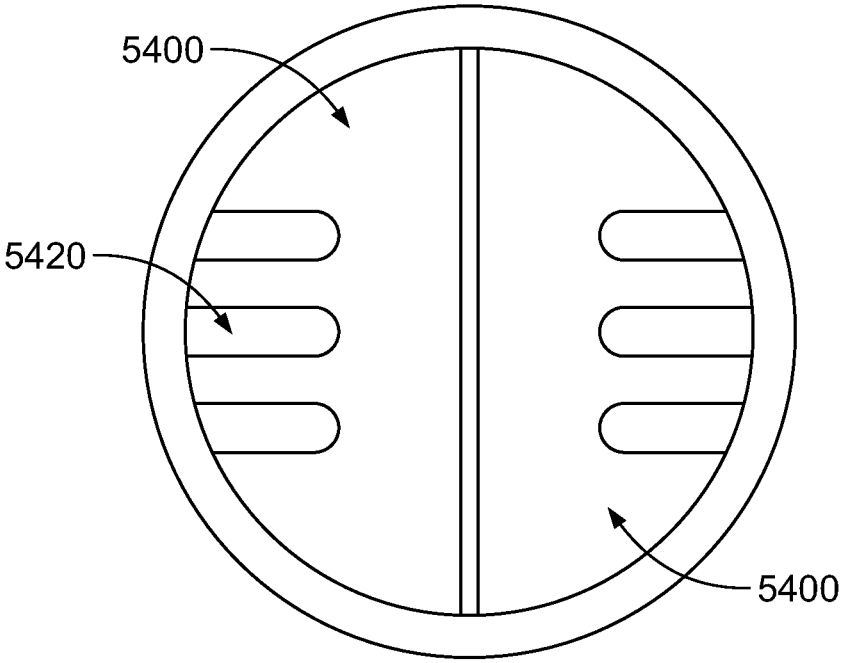
FIG. 18 is a top view of the retainer of the fifth embodiment of FIG. 15.

Each retainer 5400 may include attachment section 5470, configured to attach retainer 5400 to the inner surface of drinking cup 5200. Each attachment section 5470 may be configured to permanently or temporarily attach retainer 5400 to drinking cup 5200. For example, attachment section 5470 may permanently attach retainer 5400, configured to be disposable, to drinking cup 5200, also configured to be disposable. Attachment section 5470 may be connected to the inner surface of cup 5200, such as by welding, adhering, gluing, or sonically-welding attachment section 5470 to cup 5200. Alternatively, as shown in the figures, a single attachment section 5470 may attach both retainers 5400 to the inner wall or surface of drinking cup 5200. Attachment section 5470 may be sized and shaped such that when attachment section 5470 and/or retainer 5400 are in a folded-up configuration, as shown in FIG. 16, a plurality of drinking cups 5200 may be nested inside one another. When each retainer 5400 is folded down, as shown in FIG. 15, at least a portion of retainer 5400 may be any shape, such as flat, or a portion of a dome.

Each retainer 5400 may be disposed outside of and above the top surface of drinking cup 5200, when retainers 5400 are in the folded-up position, as shown in FIG. 16. Further, each retainer 5400 may be positionable within drinking cup 5200, so that retainers 5400 may be substantially horizontal when in the folded-down position.

A method of using drinking cup assembly 5000 may be similar to other methods of using drinking cups described herein. A method of using drinking cup assembly 5000 may include removing drinking cup 5200 from a stack of drinking cups where retainer 5400 is disposed substantially outside of drinking cup 5200 (FIG. 16), filling drinking cup 5200 with ice or an ice-substitute, as well as a liquid, and folding each retainer 5400 to a configuration in which retainer 5400 may retain the ice within drinking cup 5200—that is, from folded-up (FIG. 16), to folded-down (FIG. 15, FIG. 17), position.

Figure 19:
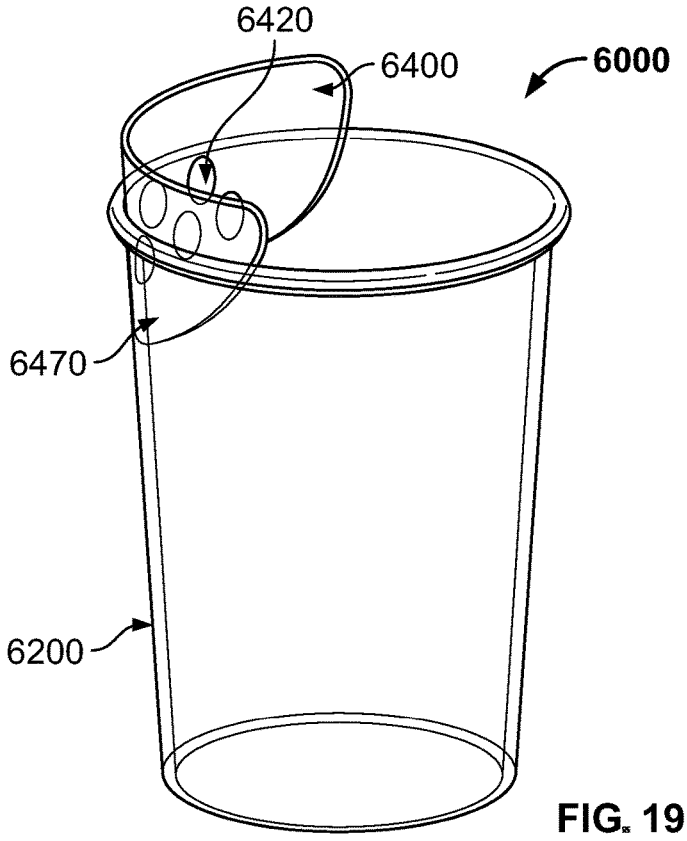
FIG. 19 is an isometric view of a sixth embodiment of the drinking cup assembly.
Figure 20:
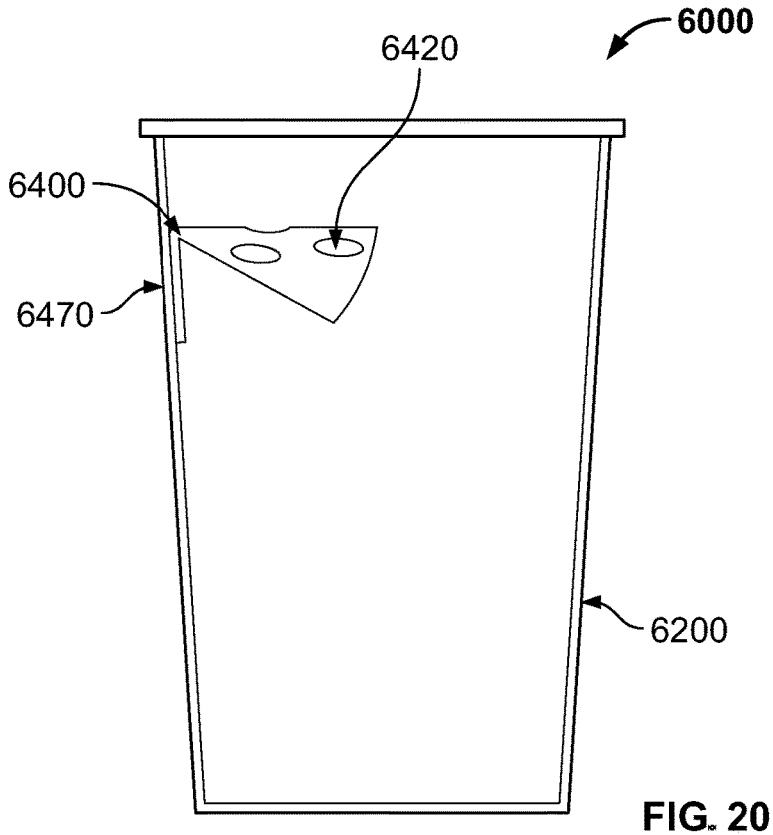
FIG. 20 is a side view of the sixth embodiment of FIG. 19

FIGS. 19-20 illustrate a sixth embodiment of the drinking cup assembly. As shown, drinking cup assembly 6000 includes drinking cup 6200 and retainer 6400. Drinking cup 6200 may be similar to the other drinking cups described herein. Retainer 6400 may be similar to the other retainers, except to the extent that retainer 6400 is described below as differing from the other retainers.

Retainer 6400 may include any number of openings—such as, for example, one, two, three, four, five, or more opening 6420. As shown in the figures, retainer 6400 includes five openings 6420. Openings 6420 may be formed anywhere within or on retainer 6400. Openings 6420 may be the same size as, or different sizes than, one or more other openings 6420. Openings 6420 may be any shape, including but not limited to slots, circles, arcs, and polygons. Openings 6420 may be distributed equally on retainer 6400, or may be distributed unequally on retainer 6400. As shown in the figures, openings 6420 may include five circles of various sizes.

Retainer 6400 may include attachment section 6470, configured to attach retainer 6400 to an inner surface of drinking cup 6200. Attachment section 6470 may be configured to permanently or temporarily attach retainer 6400 to drinking cup 6200. For example, attachment section 6470 may permanently attach retainer 6400, which is configured to be disposable, to drinking cup 6200, also configured to be disposable. Attachment section 6470 may be connected to the inner surface of drinking cup 6200, such as by welding, adhering, gluing, or sonically-welding attachment section 6470 to drinking cup 6200. Attachment section 6470 may be sized and shaped such that when attachment section 6470 and/or retainer 6400 are in a folded-up configuration, as shown in FIG. 19, a plurality of drinking cups 6200 may be nested inside one another. When retainer 6400 is folded down, as shown in FIG. 20, at least a portion of retainer 6400 may be any shape, such as flat, or a portion of a dome.

A method of using drinking cup assembly 6000 may be similar to other methods of using drinking cups described herein. A method of using drinking cup assembly 6000 may include removing drinking cup 6200 from a stack of drinking cups where retainer 6400 is disposed substantially outside of drinking cup 6200 (see FIG. 19), filling drinking cup 6200 with ice or an ice-substitute, as well as a liquid, and folding retainer 6400 from a configuration shown in FIG. 19 to a configuration in which retainer 6400 may retain the ice within drinking cup 6200 (that is, from folded up, to folded down), as shown in FIG. 20.

Figure 21:
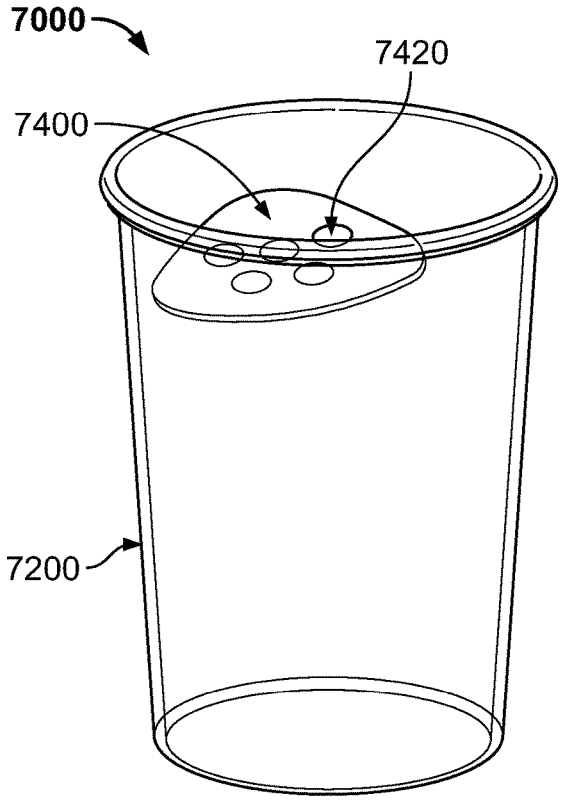
FIG. 21 is an isometric view of a seventh embodiment of the drinking cup assembly.
Figure 22:
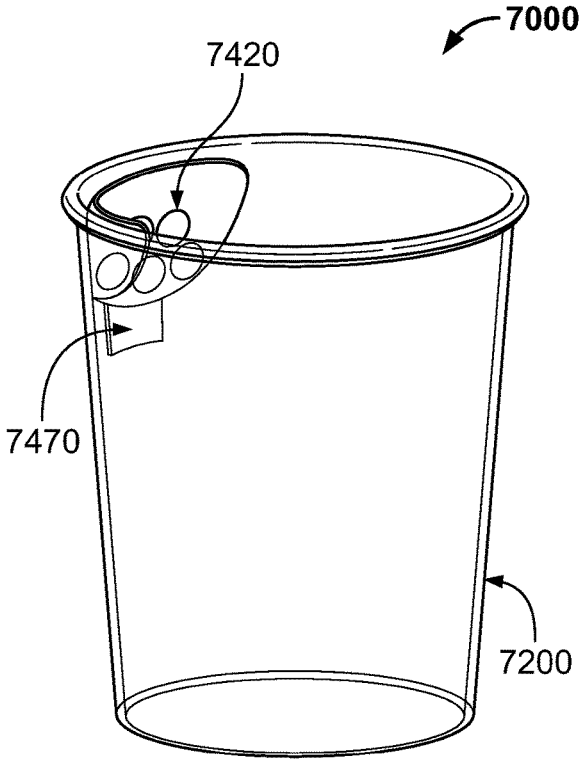
FIG. 22 is an isometric view of the seventh embodiment of FIG. 21.
Figure 23:
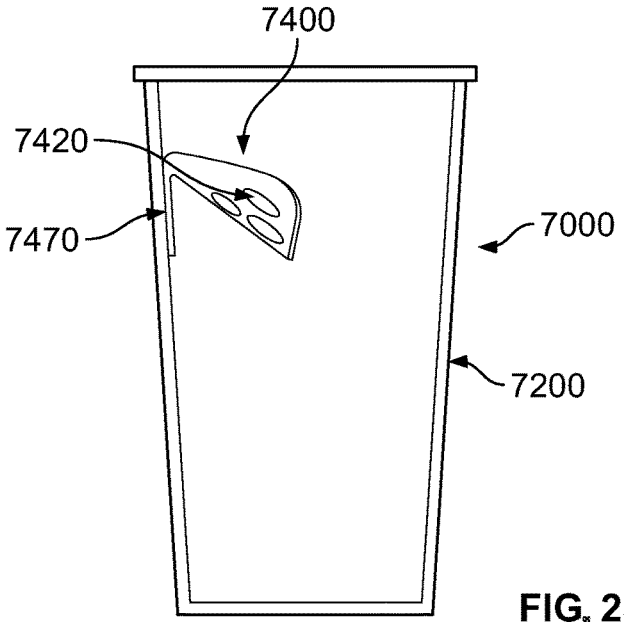
FIG. 23 is a side view of the seventh embodiment of FIG. 21.

FIGS. 21-23 illustrate a seventh embodiment of the drinking cup assembly. As shown, drinking cup assembly 7000 includes drinking cup 7200 and retainer 7400. Drinking cup 7200 may be similar to the other drinking cups described herein. Retainer 7400 may be similar to the other retainers, except to the extent that retainer 7400 is described below as differing from the other retainers.

Retainer 7400 may include any number of openings 7420, such as, for example, one, two, three, four, five, or more opening 7420. As shown in the figures, retainer 7400 includes five openings 7420. Openings 7420 may be formed anywhere within or on retainer 7400. Openings 7420 may be the same size as, or different sizes than, one or more other openings 7420. Openings 7420 may be any shape, including but not limited to slots, circles, arcs, and polygons. Openings 7420 may be distributed equally on retainer 7400, or may be distributed unequally on retainer 7400. As shown in the figures, openings 7420 may include five circles of various sizes.

Retainer 7400 may include attachment section 7470, configured to attach retainer 7400 to an inner surface of drinking cup 7200. Attachment section 7470 may be configured to permanently or temporarily attach retainer 7400 to drinking cup 7200. For example, attachment section 7470 may permanently attach retainer 7400, which is configured to be disposable, to drinking cup 7200, also configured to be disposable. Attachment section 7470 may be connected to the inner surface of drinking cup 7200, such as by welding, adhering, gluing, or sonically-welding attachment section 7470 to drinking cup 7200. Attachment section 7400 may be sized and shaped such that when attachment section 7470 and/or retainer 7400 are in a folded-up configuration, as shown in FIG. 22, a plurality of drinking cups 7200 may be nested inside one another. When in the folded-up configuration, retainer 7400 may be disposed entirely within drinking cup 7200. When retainer 7400 is folded down, as shown in FIG. 21 and FIG. 23, at least a portion of retainer 7400 may be any shape, such as flat, or a portion of a dome.

A method of using drinking cup assembly 7000 may be similar to other methods of using drinking cups described herein. A method of using drinking cup assembly 7000 may include removing drinking cup 7200 from a stack of drinking cups where retainer 7400 is folded up as shown in FIG. 22, filling drinking cup 7200 with ice and a liquid, and folding retainer 7400 to a configuration in which retainer 7400 may retain the ice within drinking cup 7200 (that is, from folded up, to folded down), as shown in FIG. 21.

Figure 24:
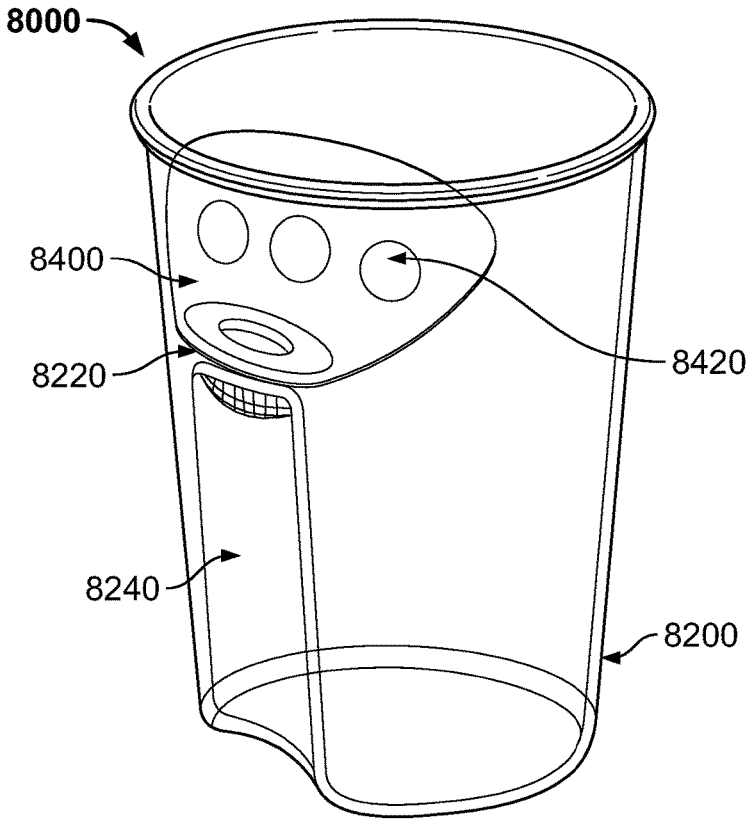
FIG. 24 is an isometric view of an eighth embodiment of the drinking cup assembly.
Figure 25:
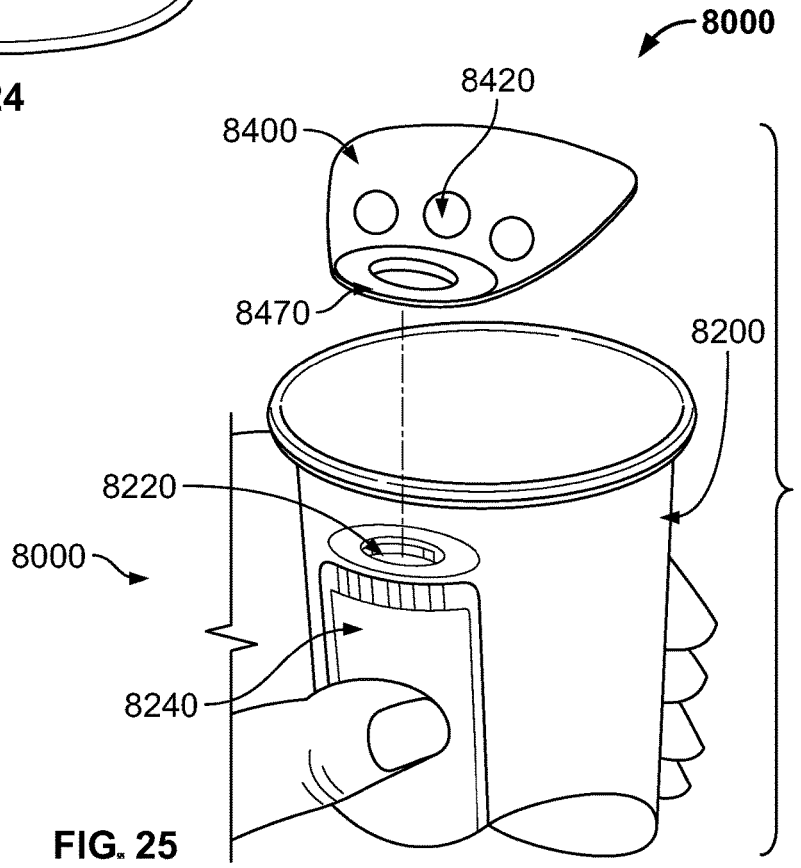
FIG. 25 is an exploded isometric view of the of the eighth embodiment of FIG. 24.

FIGS. 24-25 illustrate an eighth embodiment of the drinking cup assembly. As shown, drinking cup assembly 8000 includes drinking cup 8200 and retainer 8400. Drinking cup 8200 may be similar to the other drinking cups described herein. Retainer 8400 may be similar to the other retainers, except to the extent that retainer 8400 is described below as differing from the other retainers.

Drinking cup 8200 may include retainer attachment section 8220. Retainer attachment section 8220 may be sized, shaped, disposed, and/or oriented to connect with one or more corresponding features of retainer 8400. For example, retainer attachment section 8220 may be a recess formed during molding of drinking cup 8200. Retainer attachment section 8220 may be substantially flat, and may include a protrusion and/or depression cooperating with a corresponding depression or protrusion of retainer 8400. Drinking cup 8200 may also include a grip portion 8240, which provides a reference point for holding drinking cup 8200. For example, grip portion 8240 may be sized, shaped, oriented, and disposed to receive a thumb of the user of drinking cup 8200. Grip portion 8240 may be one or both of a recess or a protrusion. Retainer attachment section 8220 may be located at a top portion of grip portion 8240.

Retainer 8400 may include any number of openings 8420, such as, for example, one, two, three, or more opening 8420. As shown in the figures, retainer 8400 includes three openings 8420. Openings 8420 may be formed anywhere within or on retainer 8400. Openings 8420 may be the same size as, or different sizes than, one or more other openings 8420. Openings 8420 may be any shape, including but not limited to slots, circles, curves, and polygons. Openings 8420 may be distributed equally on retainer 8400, or may be distributed unequally on retainer 8400.

Retainer 8400 may include attachment section 8470, configured to attach retainer 8400 to drinking cup 8200. Attachment section 8470 may be configured to permanently or temporarily attach retainer 8400 to cup 8200. Attachment section 8470 may be substantially flat, and may include a protrusion and/or depression cooperating with a corresponding depression or protrusion of drinking cup 8200. For example, attachment section 8470 may permanently attach retainer 8400, which is intended to be disposable, to drinking cup 8200 that is intended to be disposable. Attachment section 8470 may be connected to the inner surface of cup 8200, such as retainer attachment section 8220, by achieving an interference or friction fit between retainer attachment section 8220 and attachment section 8470. Additionally or in place of the friction fit, welding, adhesive, glue, or sonic-welding may attach retainer attachment section 8220 and attachment section 8470. When retainer 8400 is folded down, at least a portion of retainer 8400 may be any shape, such as flat, or dome-shaped.

One or more of the shape or material of drinking cup 8200, retainer 8400, attachment section 8470, and/or retainer attachment section 8220 may be chosen so that drinking cups 8200 are stacked (that is, nested), when an upper drinking cup 8200 is removed from within a lower drinking cup 8200, the retainer 8400 of the lower drinking cup deploys from a configuration where it is folded against the inner wall or surface of the lower drinking cup 8200, to a configuration away from the wall of the lower drinking cup 8200, without the user having to touch or otherwise manipulate retainer 8400 into an ice-retaining position.

A method of using assembly 8000 may include attaching attachment section 8470 to cup 8200, before or after filling drinking cup 8200 with the liquid and/or ice. Retainer 8400 may be formed such that it is spring biased to a downward position—that is, from a position against the interior surface of wall of drinking cup 8200. Thus, when an upper drinking cup 8200 is removed from an interior of a lower drinking cup 8200, retainer 8400 of the lower drinking cup moves from a position against the interior wall of the lower drinking cup to an ice-retaining position, as shown in FIGS. 19 and 20.

The invention claimed is:

1. A drinking cup assembly, comprising:

a drinking cup having a rim and an interior, wherein the drinking up is configured to retain a liquid within the interior; and a first foldable retainer configured to retain ice within the interior of the drinking cup while permitting the liquid to flow from the interior of the drinking cup through the first foldable retainer, wherein the first foldable retainer comprises a first end and a second end opposite the first end, wherein the first end is joined to an interior surface of the drinking cup, wherein the second end is foldable between a first position where the second end is above the rim of the drinking cup, and a second position where the second end is below the rim and within the interior of the drinking cup, and where the second end is configured to retain the ice within the interior of the drinking cup, wherein the first foldable retainer comprises at least one opening configured to permit the liquid to flow through the opening, and retain the ice in the interior of the drinking cup.

2. The drinking cup assembly according to claim 1, wherein the at least one opening comprises multiple openings.

3. The drinking cup assembly according to claim 1, wherein the first end is welded to the interior surface of the drinking cup.

4. The drinking cup assembly according to claim 1, wherein the first end is adhered to the interior surface of the drinking cup by an adhesive.

5. The drinking cup assembly according to claim 1, wherein the first foldable retainer is entirely within the drinking cup when in the second position.

6. The drinking cup assembly according to claim 5, wherein the first foldable retainer extends from the interior surface of the drinking cup and is entirely within the drinking cup when in the second position.

7. The drinking cup assembly according to claim 1, further comprising:

a second foldable retainer, wherein the second foldable retainer comprises at least one opening configured to permit the liquid to flow through the opening, and prevent the ice from flowing through the opening.

8. The drinking cup assembly according to claim 7, wherein the first end joins both the first foldable retainer and the second foldable retainer to the interior surface of the drinking cup.

9. The drinking cup assembly according to claim 8, wherein the first end is welded or adhered to the interior surface of the drinking cup.

10. The drinking cup assembly according to claim 1, wherein the first foldable retainer comprises a first ice retaining section, wherein the first ice retaining section includes the at least one opening, and wherein when the first foldable retainer is in the first position, the first ice retaining section is out of contact with the first end.

11. The drinking cup assembly of claim 10, wherein when first foldable retainer is in the first position, the first ice retaining section and the cup attachment section extend in a same direction without any fold therebetween.

12. A drinking cup assembly, comprising:

a drinking cup having a rim and an interior, wherein the drinking up is configured to retain a liquid within the interior; and a first foldable retainer configured to retain ice within the interior of the drinking cup while permitting the liquid to flow from the interior of the drinking cup, wherein the first foldable retainer comprises a first cup attachment section and a first ice retaining section opposite the first cup attachment section and extending from the first cup attachment section, wherein the first cup attachment section is welded or adhered to an interior surface of the drinking cup, wherein the first ice retaining section comprises an opening, wherein the opening is configured to permit the liquid to flow through the opening, and configured to retain the ice in the interior of the drinking cup, wherein the first ice retaining section extends from the first cup attachment section along a same direction as the first cup attachment section, and wherein the first ice retaining section is foldable between:

a first position in which the first ice retaining section contacts the interior surface of the drinking cup without contacting the first cup attachment section, and is above the rim, and a second position in which the first ice retaining section is out of contact with the interior surface of the drinking cup and is disposed within the interior of the cup to thereby permit the liquid in the cup to flow through the opening while retaining the ice within the interior of the drinking cup.

13. The drinking cup assembly of claim 12, wherein the first foldable retainer is disposed entirely within the interior of the drinking cup when disposed in the second position.

14. The drinking cup assembly of claim 12, further comprising:

a second foldable retainer, wherein the second foldable retainer comprises a second ice retaining section.

15. The drinking cup assembly of claim 14, wherein the second ice retaining section extends from the first cup attachment section.

16. The drinking cup assembly of claim 14, wherein the second foldable retainer comprises a second cup attachment section.

17. The drinking cup assembly of claim 16, wherein the second cup attachment section is joined to the interior surface of the drinking cup.

* * * * *